US011472207B2

(12) United States Patent
Sanada et al.

(10) Patent No.: US 11,472,207 B2
(45) Date of Patent: Oct. 18, 2022

(54) STRUCTURE FOR SUPPORTING PLATEN ROLLER AND PRINTER

(71) Applicant: TOSHIBA TEC KABUSHIKI KAISHA, Tokyo (JP)

(72) Inventors: Tsuyoshi Sanada, Susono Shizuoka (JP); Yuji Kawamorita, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 113 days.

(21) Appl. No.: 17/129,677

(22) Filed: Dec. 21, 2020

(65) Prior Publication Data

US 2021/0252882 A1 Aug. 19, 2021

(30) Foreign Application Priority Data

Feb. 14, 2020 (JP) ..... JP2020-023709

(51) Int. Cl.
*B41J 11/04* (2006.01)
*B41J 3/407* (2006.01)

(52) U.S. Cl.
CPC ..... *B41J 11/04* (2013.01); *B41J 3/4075* (2013.01)

(58) Field of Classification Search
CPC . B41J 11/04; B41J 3/4075; B41J 11/10; B41J 11/13; B41J 11/057; B41J 11/06; B41J 11/08; B41J 11/02; B41J 11/053
See application file for complete search history.

(56) References Cited

U.S. PATENT DOCUMENTS

2005/0271441 A1* 12/2005 Bouverie ..... B41J 2/325 400/234
2006/0115311 A1* 6/2006 Son ..... B41J 3/60 400/120.16
2011/0214820 A1* 9/2011 Sato ..... B65C 9/46 156/764

FOREIGN PATENT DOCUMENTS

JP S60-41253 U 3/1985
JP H04-27569 A 1/1992

* cited by examiner

*Primary Examiner* — Kristal Feggins
(74) *Attorney, Agent, or Firm* — Kim & Stewart LLP

(57) ABSTRACT

A support structure for a detachable platen roller of a printer that rotates to feed paper, or the like includes a frame that holds the platen roller and a pair of bushings attached to the frame. Ends of a shaft of the platen roller are inserted into the bushings. A part of either the frame or each of the bushings located around the shaft and closer to a guide surface of the platen roller than the frame in a longitudinal direction of the platen roller forms a support part that receives a force applied by a print head pressing against the platen roller.

20 Claims, 4 Drawing Sheets

STRUCTURE FOR SUPPORTING PLATEN ROLLER AND PRINTER

CROSS-REFERENCE TO RELATED APPLICATIONS

This application is based upon and claims the benefit of priority from Japanese Patent Application No. 2020-023709, filed Feb. 14, 2020, the entire contents of which are incorporated herein by reference.

FIELD

Embodiments described herein relate generally to a structure for supporting a platen roller and a printer incorporating a structure for supporting a platen roller.

BACKGROUND

Conventional printers that convey a printing medium using a platen roller are designed so that the platen roller does not bend and become inoperative even when pressed by a print head. The platen roller is supported by a frame at both ends of a rotary shaft, and a bushing that assists in the sliding between the frame and the rotary shaft is interposed therebetween.

Generally, the rotary shaft has had a thickness sufficient to provide rigidity. However, in recent years, in order to reduce the weight of the printer or reduce its manufacturing cost, a shaft having a small diameter has been used as the rotary shaft. When the shaft of the platen roller has a small diameter, the rigidity lessens and may be insufficient, and the platen roller pressed by the print head may be bent.

DETAILED DESCRIPTION

According to one or more embodiments, a support structure for a detachable platen roller of a printer comprises a frame configured to hold the platen roller. The support structure includes a pair of bushings attached to the frame and permitting ends of a shaft of the platen roller to be inserted therein. A part of either the frame or each of the bushings located around the shaft and closer to a guide surface of the platen roller than the frame in a longitudinal direction of the platen roller forms a support part configured to receive a force applied by a print head pressing against the platen roller.

First Embodiment

Figure 1:
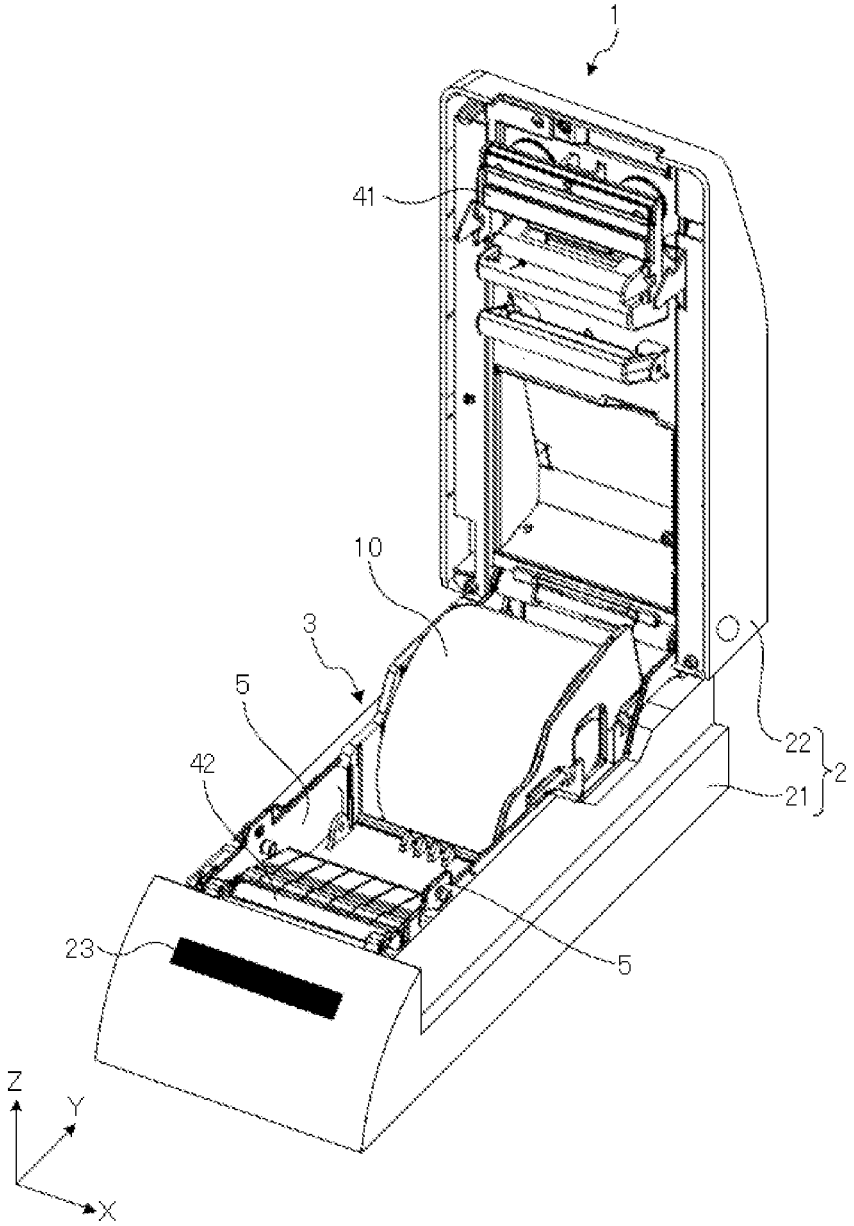
FIG. 1 is a perspective view illustrating a printer according to an embodiment.

Embodiments will be described with reference to the drawings. FIG. 1 is a perspective view illustrating a printer 1 according to an embodiment. In the following description, an orthogonal coordinate system composed of an X-axis, a Y-axis, and a Z-axis will be used for convenience. The X-axis is a width direction (left-right direction) of the printer 1, the Y-axis is a depth direction (front-rear direction) of the printer 1, and the Z-axis is a height direction (up-down direction) of the printer 1. In the figure, the directions indicated by the arrows are the positive directions, and the positive direction of the Y-axis is towards the rear side from the front side of the printer 1, and the positive direction of the Z-axis is the upwards direction.

The printer 1 prints on a roll paper 10, and includes a housing 2, a sheet storage unit 3, and a printing unit that includes a print head 41 and a platen roller 42. The roll paper 10 is an example of a printing medium, and is, for example, a paper sheet on which a plurality of labels each having a glue layer on a back surface. The roll paper 10 is wound around a core or the like. The housing 2 includes a main body 21 and a cover 22, and houses the sheet storage unit 3, the print head 41, and the platen roller 42.

The main body 21 is, for example, a box-shaped container having an opening, and includes the sheet storage unit 3 and the like. Further, a sheet discharge port 23 is provided on a front surface of the main body 21. The sheet discharge port 23 is an opening through which the printed sheet is discharged.

The cover 22 is rotatably supported (e.g., hinged) at one end portion (hereinafter referred to as "rotation side end portion") of the main body 21, and moves between an open position at which the main body 21 is not covered by the cover 22 opened and a close position at which the main body 21 is covered by the cover 22. The cover 22 has a flap shape configured to cover the main body 21. Further, the cover 22 is biased in a direction from the closed position toward the open position (a direction away from the main body 21) by a biasing member such as a spring.

The sheet storage unit 3 is provided in the main body 21 and covered by the cover 22. Further, the sheet storage unit 3 holds and stores the roll paper 10 so that the sheet can be pulled out by the platen roller 42.

The print head 41 and the platen roller 42 make up a printing unit provided at a position where the end portion of the cover 22 contacts the main body 21 (i.e., the end portion opposite to the rotation side end portion), and configured to print on the sheet drawn out from the sheet storage portion 3.

The print head 41 is attached to the cover 22. The platen roller 42 is provided in the main body 21. With the cover 22 in the closed position, the platen roller 42 contacts the print head 41, and the printing unit is in a printable state. More specifically, the print head 41 is attached to the cover so as to be rotatable about an axis along the width direction (i.e., X-axis direction), and is biased by an elastic member such as a spring towards the platen roller 42 when the cover 22 is in the closed position.

The print head 41 is, for example, a thermal head, and prints on a printing surface of a label by heating a thermosensitive color developing layer included in the printing surface of the label to cause the color developing layer to develop a color. The platen roller 42 sandwiches the sheet with the print head 41, rotates about the longitudinal direction to pull out the sheet from the sheet storage unit 3, and conveys the sheet.

Both ends of the platen roller 42 are rotatably supported by a frame 5 in the main body 21. The frame 5 has a pair of metal sheets along the YZ plane, other metal sheets between the pair of metal sheets and fixed to the pair of metal sheets, and the like. The frame 5 supports various components between the two opposing metal sheets and the like.

Figure 2:
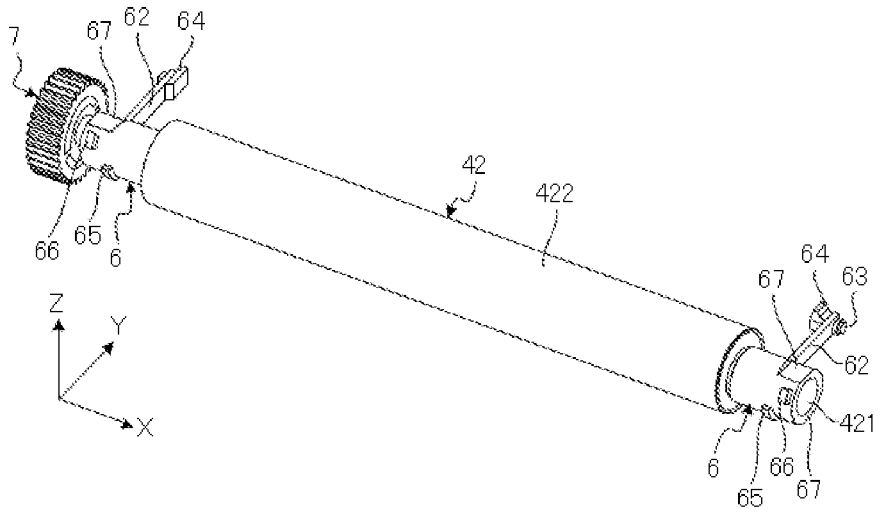
FIG. 2 is a perspective view illustrating a platen roller and a bushing according to an embodiment.
Figure 3:
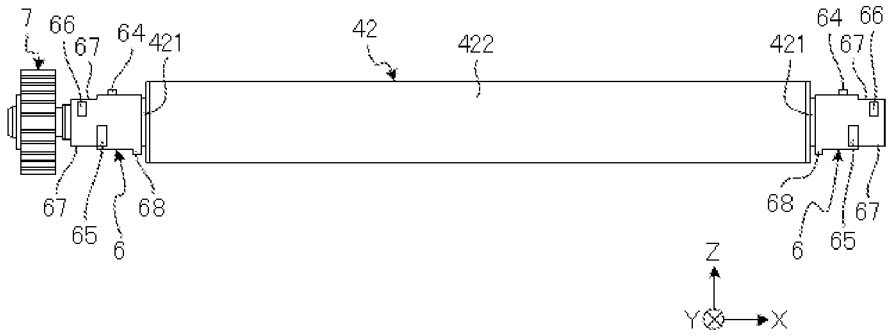
FIG. 3 is a front view illustrating a platen roller and a bushing according to an embodiment.

FIG. 2 is a perspective view illustrating the platen roller 42 and a bushing 6. FIG. 3 is a front view of the platen roller 42 and the bushing 6. The platen roller 42 has a metal rotary shaft 421 as a core. Further, a guide portion 422 is a cylindrical outer peripheral surface that contacts and guides the roll paper 10 (i.e., the guide surface). The guide portion 422 is made of a material having elasticity such as rubber. The rotary shaft 421 protrudes from both ends of the guide portion 422 in the X direction.

Figure 4:
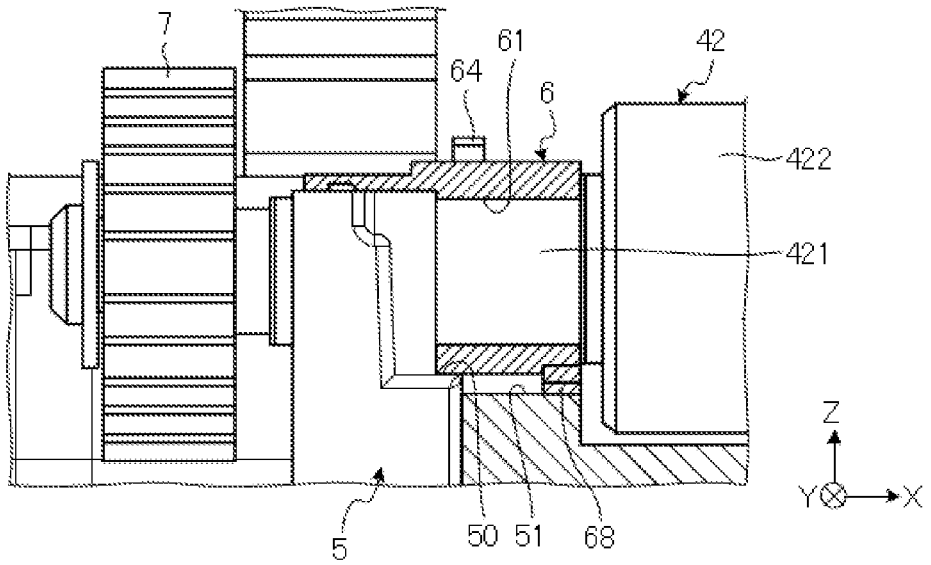
FIG. 4 is a diagram illustrating a positional relationship between an end portion of a platen roller and a bushing and a frame according to an embodiment.

FIG. 4 is a diagram illustrating a positional relationship between the end portion of the platen roller 42 and the bushing 6 and the frame 5. The bushing 6 is a molded resin member and has a cylindrical inner peripheral surface 61. Both ends of the rotary shaft 421 are inserted into a bushing 6 and contact the inner peripheral surface 61. Both ends of the rotary shaft 421 are slidable with respect to the inner peripheral surface 61. A bushing 6 is interposed between the frame 5 and each of the ends of the rotary shaft 421 and is fixed to the frame 5. As a result, the platen roller 42 is rotatable while being supported by the frame 5. One end portion of the rotary shaft 421 of the platen roller 42 is coupled to a gear 7. The gear 7 rotates by a motor so that the platen roller 42 rotates.

Referring back to FIG. 2, the bushing 6 has a lever 62 for receiving a positioning operation on the frame 5, a protrusion 63 for fixing the lever 62 to the frame 5, a claw 64 for releasing the fixed state by the protrusion 63, and ribs 65 and 66 for preventing displacement in the width direction (i.e., the X-axis direction) with respect to the frame 5.

In addition, the bushing 6 has a pair of flat portions 67 along the longitudinal direction of the lever 62 on the outer circumferential surface thereof. The flat portion 67 has a shape in which a part of the cylindrical outer peripheral surface is removed and a flattened portion is provided. A distance between the flat portions 67 facing each other across the rotary shaft 421 is less than a diameter of the outer peripheral surface of the bushing 6.

The frame 5 has a support portion 50 (see FIGS. 4 to 6) and a communicating portion. The support portion 50 is, for example, a hole having an arc-shaped edge. The support portion 50 supports the outer peripheral surface of the bushing 6 at the edge. The communicating portion is, for example, a groove from the outer edge of the frame 5 to the support portion 50. The communication portion is for inserting the bushing 6 into the support portion 50 from the edge of the frame 5, and is provided along the height direction (i.e., the Z-axis direction). The support portion 50 has substantially the same diameter as the outer peripheral surface of the bushing 6. The width of the communicating portion is less than the diameter of the support portion 50 and is substantially the same as the distance between the opposing flat portions 67 of the bushing 6.

In a state in which the platen roller 42 is attached to the frame 5, the longitudinal direction of the lever 62 is aligned with the depth direction (i.e., the Y-axis direction) of the printer 1. In this state, the protrusion 63 fits into a recess provided in the frame 5, and the lever 62 is fixed. To remove the protrusion 63 from the recess, the claw 64 is moved in the X-axis direction. To detach the platen roller 42 from the frame 5, the lever 62 is rotated upward, and pulled upward (i.e., the Z-axis positive direction) as it is. As a result, the flat portion 67 slides on the communicating portion of the frame 5, and the bushing 6 is pulled out.

The attachment of the platen roller 42 to the frame 5 is made in the way opposite to the above-described operation. With the lever 62 facing upward, the bushing 6 is inserted downward (i.e., the Z-axis negative direction) into the communication portion (groove) of the frame 5, and the lever 62 is rotated so that the bushing 6 rotates approximately ¼ in the support portion 50 (hole) of the frame 5. When reaching a predetermined position, the protrusion 63 fits in the recess of the frame 5.

The distance between the rib 65 and the rib 66 in the X-axis direction corresponds to a thickness of a plate material that forms the frame 5. In the state in which the bushing 6 is correctly attached to the frame 5, the edge of the support portion 50 of the frame 5 is sandwiched between the rib 65 and the rib 66. Thereby, the positions of the bushing 6 and the platen roller 42 in the X-axis direction are fixed.

Figure 5:
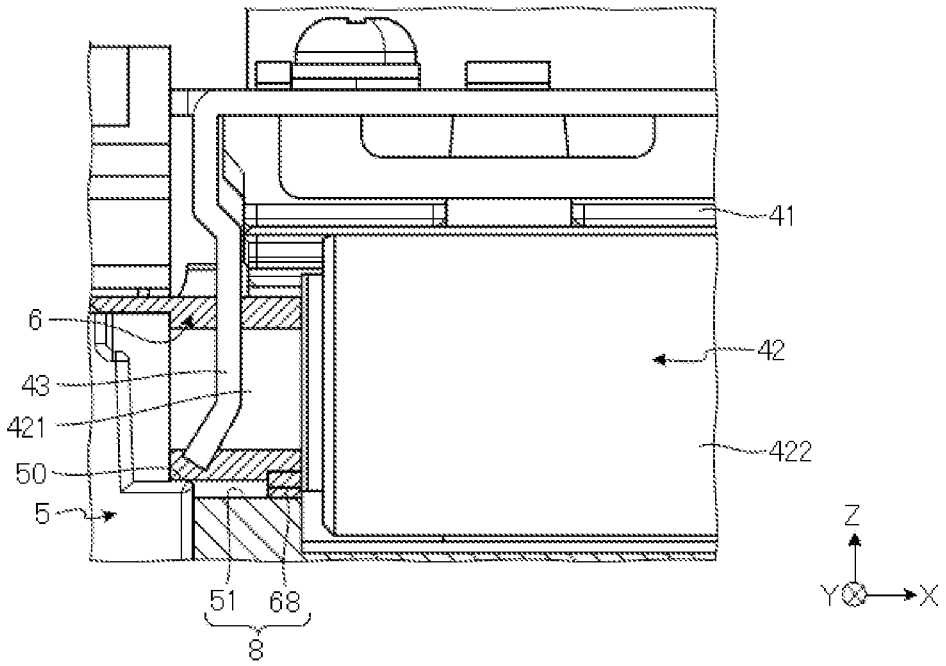
FIG. 5 is a diagram illustrating a positional relationship between a platen roller and a print head according to an embodiment.

FIG. 5 is a diagram illustrating a positional relationship between the platen roller 42 and the print head 41. The print head 41 presses the platen roller 42 and comes into pressure contact with the platen roller 42. A guide member 43 that regulates the movement of the roll paper 10 in the width direction is attached to the print head 41. The width of the print head 41 is longer than the width of the guide portion 422 of the platen roller 42. The guide member 43 regulates the position of the roll paper 10 in accordance with the dimension in the width direction of the print head 41.

Here, the bushing 6 is further provided with an auxiliary support 8. The auxiliary support 8 is provided at an end portion of the platen roller 42 closer to the guide portion 422. The auxiliary support 8 has a projection 68 that protrudes in the radial direction from the outer peripheral surface of the bushing 6. The projecting direction of the projection 68 is substantially downward in a state in which the platen roller 42 is attached to the frame 5. In this state, the projection 68 contacts a receiving surface 51 of the frame 5. The receiving surface 51 is an upward plane.

By the contact of the projection 68 to the receiving surface 51, a downward force from the print head 41 by the platen roller 42 is received, and thus, the deflection of the platen roller 42 is reduced. Further, since the receiving surface 51 is an upward plane, it is possible to stably receive the force.

Further, the contact position between the protruding portion 68 and the receiving surface 51 is preferable because the bending of the platen roller 42 due to the pressing of the print head 41 can be suppressed as the position in the X-axis direction is closer to the print head 41 and closer to the guide portion 422 of the platen roller 42.

Figure 6:
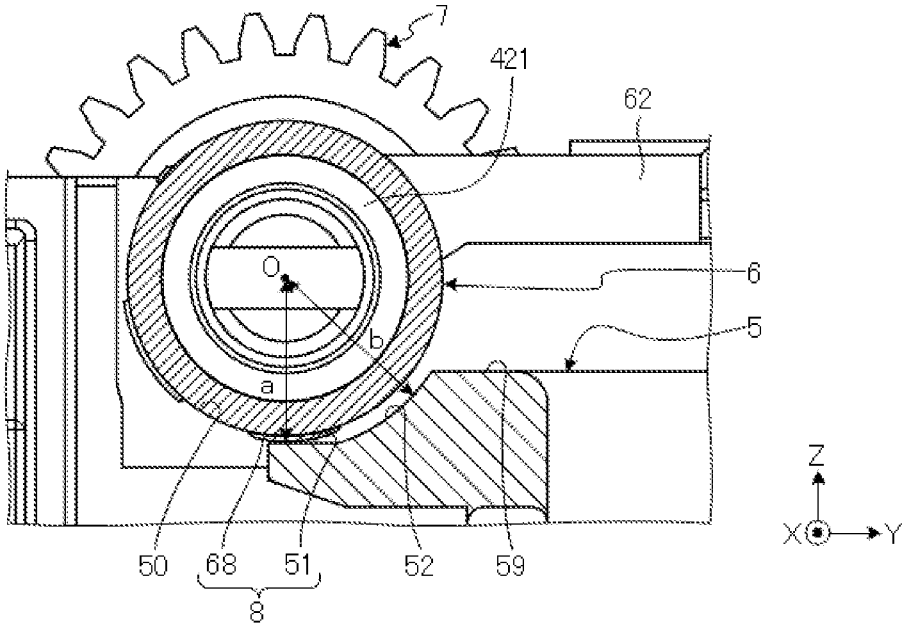
FIG. 6 is a diagram illustrating a contact state in which a bushing contacts a frame according to an embodiment.

FIG. 6 is a diagram illustrating a contact state in which the bushing 6 contacts the frame 5. In one embodiment, the projection 68 is formed in a state in which a part of the outer peripheral surface of the bushing 6 protrudes in the radial direction. In addition, the frame 5 has an introduction face 52 between an upper face 59 and the receiving surface 51. The introduction face 52 contacts the projection 68 in the process of attaching the platen roller 42 to the frame 5. More specifically, in the YZ plane, the introduction face 52 has an arc shape having a diameter b larger than a distance a from the axis (center) O of the bushing 6 to the projection 68. Due to the presence of the introduction face 52, when the bushing 6 is mounted on the frame 5, the projection 68 which rotates according to the rotation of the lever 62 does not come into contact with the frame 5 before reaching the receiving face 51, nor does it slide strongly even if it touches the frame 5 before reaching the receiving surface 51. That is, even when the projection 68 is provided, it is possible to maintain good operability when the bushing 6 is mounted on the frame 5.

In such a configuration, in the operation of the printer 1, the cover 22 in the open position in the state shown in FIG. 1 can be moved to the closed position. Accordingly, the print head 41 comes into pressure contact with the platen roller 42. In this state, the movement of the roll paper 10 in the width direction is regulated by the guide member 43, and the roll paper 10 is sandwiched between the print head 41 and the platen roller 42 with the printing surface facing the print head 41.

In the operable state of the printer 1, the platen roller continues to receive a force from the print head 41. However, a part of the force is received by the receiving surface 51 in contact with the projection 68. Here, in a conventional structure, the support portion 50 only supports the outer peripheral surface of the bushing 6, and there is no contact in the auxiliary support 8, so that the force is not received at this position. On the other hand, in the present embodiments, since the projection 68 and the receiving surface 51 are in contact with each other in the auxiliary support 8, deflection of the platen roller 42 can be reduced because the force to bend the platen roller 42 is reduced.

According to the embodiments described above, even if the diameter of the rotary shaft 421 of the platen roller 42 is small, it is possible to prevent the deflection of the rotary shaft 421 of the platen roller 42 due to the pressing of the print head 41.

In the above-described embodiments, the projection 68 is provided on a part of the outer circumferential surface of the bushings 6. However, the projection 68 may have a shape that surrounds the outer circumferential surface of the bushing(s) 6 by one circumference, and the deflection of the platen roller 42 may be reduced or prevented.

Variation

Next, a modified example of the above-described embodiments will be described. The same parts as those in the above-described embodiments will be denoted by the same reference numerals.

Figure 7:
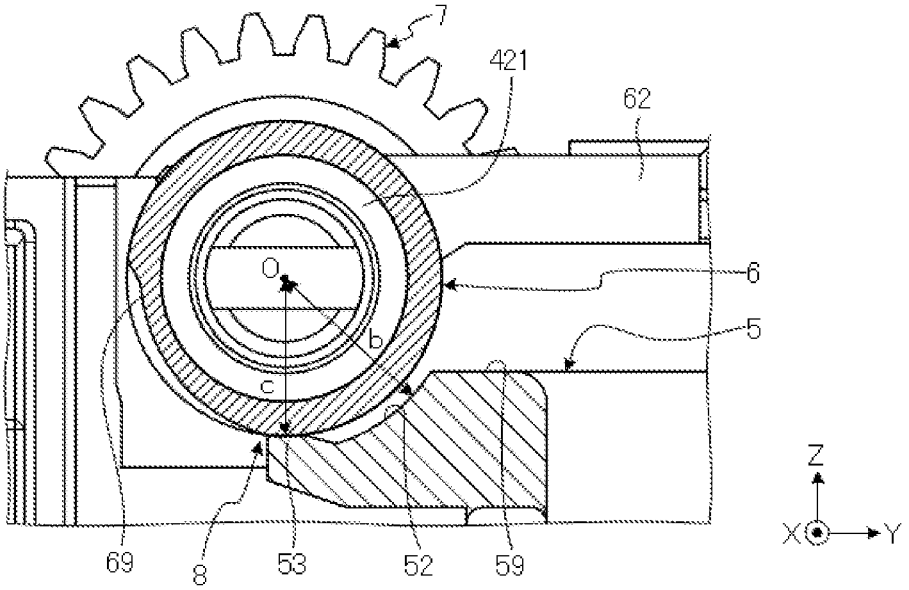
FIG. 7 is a diagram illustrating a contact state in which a bushing contacts a frame according to an embodiment.

FIG. 7 is a view illustrating another example of the contact state in which the bushing 6 contacts the frame 5.

Instead of the projection 68 shown in FIG. 6, a projection 53 is formed on the frame 5 to as to protrude towards the center of the bushing 6. The projection 53 is located at a terminal end of the introduction face 52.

Further, the bushing 6 has a cutout 69. The cutout 69 is a portion in which a part of the outer circumferential surface of the bushing 6 on the guide portion 422 side is partially removed. When the platen roller 42 is mounted on the frame 5, the cutout 69 is retracted from the projection 53 and faces the projection 53. This avoids an increase in the force required to be applied during the sliding.

The auxiliary support 8 in the above-described embodiments has a protruding portion in one of the bushing 6 or the frame 5. Alternatively, both the bushing 6 and the frame 5 may have protrusions, and the protrusion portions may be in contact with each other to obtain a desired effect (e.g., reduction of the deflection of the platen roller 42).

Further, when at least one of a part of the bushing 6 in contact with the auxiliary support 8 and a part of the frame 5 is a flat surface, it is possible to stably receive the force.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed:

1. A support structure for a detachable platen roller of a printer, the support structure comprising:

a frame configured to hold a detachable platen roller; and a pair of bushings attached to the frame and permitting ends of a shaft of the detachable platen roller to be inserted therein, wherein a part of either the frame or each of the bushings located around the shaft and closer to a guide surface of the detachable platen roller than the frame in a longitudinal direction of the detachable platen roller forms a support part configured to receive a force applied by a print head pressing against the detachable platen roller.

2. The support structure according to claim 1, wherein a part of each of the bushings forms the support part that protrudes in a radial direction.

3. The support structure according to claim 2, wherein the support part contacts the frame downwardly when the detachable platen roller is attached to the frame.

4. The support structure according to claim 1, wherein the support part is a part of the frame that protrudes toward each of the bushings.

5. The support structure according to claim 4, wherein each of the bushings has a recess having a depth corresponding to a height of the support part.

6. The support structure according to claim 1, further comprising:

a lever that rotates around a rotation axis of the detachable platen roller and between a first position at which the detachable platen roller can be detached from the frame and a second position at which the detachable platen roller is attached to the frame.

7. The support structure according to claim 6, wherein the frame includes a curved surface that faces an outer surface of each of the bushings and does not contact the outer surface when the lever is at the second position.

8. The support structure according to claim 6, wherein the frame supports the shaft via the support part when the lever is at the second position.

9. The support structure according to claim 6, wherein each of the bushings has a protrusion that engages a recess of the frame such that the lever is held at the second position.

10. The support structure according to claim 1, wherein each of the bushings has a rib that restricts movement of the platen roller in the longitudinal direction.

11. A printer, comprising:

a print head;

a detachable platen roller configured to rotate to feed a medium when the medium is between the detachable platen roller and the print head;

a frame configured to hold the detachable platen roller; and a pair of bushings attached to the frame, ends of a shaft of the detachable platen roller being inserted into the pair of bushings, wherein a part of either the frame or each of the bushings located around the shaft and closer to a guide surface of the detachable platen roller than the frame in a longitudinal direction of the detachable platen roller forms a support part configured to receive a force applied by the print head pressing against the detachable platen roller.

12. The printer according to claim 11, wherein a part of each of the bushings forms the support part that protrudes in a radial direction.

13. The printer according to claim 12, wherein the support part contacts the frame downwardly when the detachable platen roller is attached to the frame.

14. The printer according to claim 11, wherein the support part is a part of the frame that protrudes toward each of the bushings.

15. The printer according to claim 14, wherein each of the bushings has a recess having a depth corresponding to a height of the support part.

16. The printer according to claim 11, further comprising:

a lever that rotates around a rotation axis of the detachable platen roller and between a first position at which the detachable platen roller can be detached from the frame and a second position at which the detachable platen roller is attached to the frame.

17. The printer according to claim 16, wherein the frame includes a curved surface that faces an outer surface of each of the bushings and does not contact the outer surface when the lever is located at the second position.

18. The printer according to claim 16, wherein the frame supports the shaft via the support part when the lever is located at the second position.

19. The printer according to claim 16, wherein each of the bushings has a protrusion that engages a recess of the frame such that the lever is held at the second position.

20. The printer according to claim 11, wherein the medium is a label paper fed from a label roll stored in the frame.

* * * * *